US008822827B2

(12) United States Patent
Amils

(10) Patent No.: US 8,822,827 B2
(45) Date of Patent: Sep. 2, 2014

(54) STEEL CORE FOR AN ELECTRIC TRANSMISSION CABLE AND METHOD OF FABRICATING IT

(75) Inventor: Xavier Amils, Kortrijk (BE)

(73) Assignee: NV Bekaert SA, Zwevegem (BE)

( * ) Notice: Subject to any disclaimer, the term of this patent is extended or adjusted under 35 U.S.C. 154(b) by 765 days.

(21) Appl. No.: 12/522,309

(22) PCT Filed: Jan. 16, 2008

(86) PCT No.: PCT/EP2008/050467

§ 371 (c)(1),
(2), (4) Date: Jul. 7, 2009

(87) PCT Pub. No.: WO2008/098811

PCT Pub. Date: Aug. 21, 2008

(65) Prior Publication Data

US 2009/0308637 A1 Dec. 17, 2009

(30) Foreign Application Priority Data

Feb. 16, 2007 (EP) ..... 07003310

(51) Int. Cl.
*H01B 1/02* (2006.01)
*H01B 5/10* (2006.01)
*H01B 13/00* (2006.01)

(52) U.S. Cl.
CPC ..... *H01B 5/104* (2013.01); *D07B 2201/2059* (2013.01); *H01B 13/0006* (2013.01)
USPC ..... 174/128.1

(58) Field of Classification Search
USPC ..... 174/128.1
See application file for complete search history.

(56) References Cited

U.S. PATENT DOCUMENTS

| | | | | |
|---|---|---|---|---|
| 1,943,087 | A | 1/1934 | Potter et al. | |
| 3,131,469 | A * | 5/1964 | Glaze | 228/136 |
| 5,243,137 | A | 9/1993 | Gentry | |
| 5,374,783 | A * | 12/1994 | Gentry | 174/128.1 |
| 5,496,969 | A * | 3/1996 | Blackmore | 174/113 R |
| 6,307,156 | B1 * | 10/2001 | Avellanet | 174/128.1 |
| 2005/0266240 | A1 * | 12/2005 | Kim et al. | 428/364 |
| 2005/0279074 | A1 * | 12/2005 | Johnson et al. | 57/212 |

FOREIGN PATENT DOCUMENTS

JP 54-148284 A 11/1979

OTHER PUBLICATIONS

Thrash Jr., "Transmission Conductors—A review of the design and selection criteria", Southwire Communications, Jan. 31, 2003, 9 pgs.

* cited by examiner

*Primary Examiner* — Chau N Nguyen
(74) *Attorney, Agent, or Firm* — Foley & Lardner LLP

(57) ABSTRACT

An electric transmission-cable is provided, comprising a cable core having at least two individually coated and stranded wires, and a conductor surrounding the core, wherein the core is compacted. Further, a method of fabricating such compacted steel core is provided.

9 Claims, 2 Drawing Sheets

STEEL CORE FOR AN ELECTRIC TRANSMISSION CABLE AND METHOD OF FABRICATING IT

FIELD OF THE INVENTION

The present invention relates to the field of electric transmission cables and methods of fabricating it.

BACKGROUND OF THE INVENTION

Nowadays an enormous amount of electric energy power is transported and consumed. A current trend is to buy electricity where it is cheapest, resulting in an enormous amount of electricity transport over large distances by using the existing electricity distribution network.

Because the capacity of the existing electricity distribution network is getting insufficient, it should be upgraded in the near future.

An obvious solution could be building new additional electric power transmission lines, but economical and ecological reasons prevent this in a lot of cases.

Another solution could be increasing the amount of electrical current flowing through the existing lines. However, as heat generation increases quadratic with the current, the nominal operating temperature rises then from about 50° C. up to about 200° C. and even 300° C. The existing electric power transmission lines equipped with traditional ACSR (aluminum conductor steel reinforced) cables are not suitable for operating at these temperatures. With rising temperatures, the conductors (mostly aluminum) which also partially mechanically support the cable, loose their mechanical strength leading to significant sag. In addition, the zinc of the galvanized steel wires of the core diffuses and forms a brittle iron-zinc layer causing flaking and decreasing corrosion resistance. In case of ACSS (aluminum conductor steel supported) cables, where the aluminum conductors do not mechanically support the cable, thermal expansion of the steel core leads to significant sag at high operating temperatures.

Another solution could lie in using an increased conductor section to increase the conductor current carrying capacity. This would obviously result in increased cable diameter, thereby increasing ice and wind loading. Higher ice and wind loading increases pole/tower loading and oblige shorter design spans. To be able to increase the conductor section without increasing the cable diameter, trapezoidal shaped wires and compacting techniques are used to compact the conductor section.

As described in "Transmission conductors—A review of the design and selection criteria" by Southwire Communications (Jan. 31, 2003), compact conductors can be manufactured by passing the stranded cable through powerful compacting rolls or a compacting die. Another technique as described is stranding trapezoidal shape wired conductors. Their shape results also in less void area in between the conductors and a reduced cable diameter.

However, since electricity consumption is still increasing, the need is clearly felt for an electric transmission cable either with the same cable diameter compared to the existing electric transmission cables, but having an increased conductor current carrying capacity, either with a smaller cable diameter, but keeping at least the same conductor current carrying capacity. Furthermore, the load carrying core should have at least the same tensile strength as compared to conventional cores and at least the same corrosion resistance.

In accordance with the present invention, an improved core for electric transmission cable and method of fabricating it is now presented to overcome all drawbacks of the prior art and to fulfill this need.

SUMMARY OF THE INVENTION

The invention is directed to a method for fabricating a core for an electric transmission cable comprising providing at least two wires and coating them stranding the coated wires thereby forming a core compacting the core The number of wires in the core may be between 5 and 25, and preferably 7 or 19.

The step of compacting may be preferably in line with the step of stranding.

The step of compacting the core may be preferably done by means of compacting rolls.

The core may be compacted or made from trapezoidal shaped compacted wires.

The wires of the core may be made of high-carbon steel.

The wires may be coated by means of any coating keeping sufficient coating properties after compacting.

The wires may be coated with, but not limited to zinc, zinc-aluminum or zinc-aluminum-magnesium types of alloy. A zinc-aluminum coating is a preferred coating.

The weight of the coating on the steel wires may be more than 100 g/m$^2$, and preferably more than 200 g/m$^2$.

The method may further comprise the step of additionally coating the compacted core.

The method may further comprise the step of forming a conductor surrounding the compacted core.

The conductor may be made of, but not limited to aluminum, aluminum alloy, aluminum-magnesium-silicon alloy, aluminum composite.

Further, the invention is directed to an electric transmission cable comprising a cable core having at least two individually coated and stranded wires and a conductor surrounding the core wherein the core is compacted.

The invention is also directed to the use of a compacted core in an electric transmission cable.

DESCRIPTION OF THE INVENTION

A person skilled in the art will understood that the embodiments described below are merely illustrative in accordance with the present invention and not limiting the intended scope of the invention. Other embodiments may also be considered.

As a first object, the present invention provides a method for fabricating a core for an electric transmission cable comprising providing at least two wires and coating them stranding the coated wires thereby forming a core compacting the core As already described above, compacted conductors are known in the state of the art and even widely applied. However, prior art never suggested to compact the core of an electric transmission cable, as persons skilled in the art would expect that, when compacting the core, thereby deforming individually coated wires to the degree they loose their circularity, the coating would be significantly damaged, leading to diminished parameters such as loss of corrosion resistance. In accordance with the present invention however, a cable core from individually coated and stranded wires can indeed be compacted when using a suitable coating and performing the compacting step using suitable processing parameters. When matching coating and compacting, the coating corrosion resistance is not decreased when compared to standard non compacted or non trapezoidal wire shapes.

Figure 1:
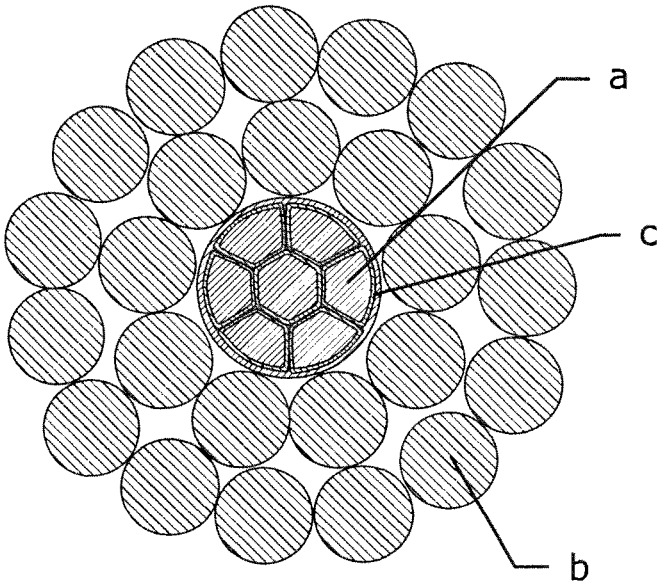
FIG. 1 illustrates a cross-section of an electric transmission cable with a compacted steel core according to the invention.
Figure 2:
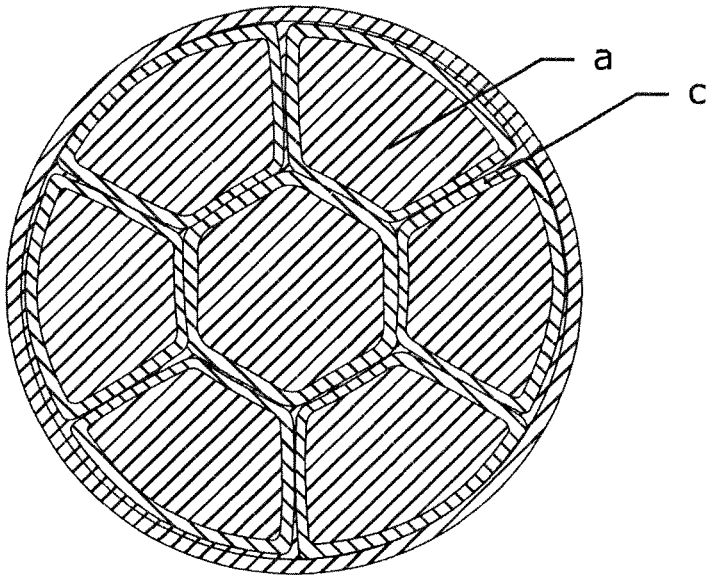
FIG. 2 illustrates an enlarged view of the core section of FIG. 1.

FIG. 1 is a cross-section of an electric transmission cable according to an embodiment of the invention showing a compacted core (a), a conductor section (b), and coatings (c). FIG. 2 is an enlarged view of the core section of FIG. 1.

After coating, the wires of the core are stranded and compacted. In parallel, the conductor wires are stranded around the compacted core. The step of compacting the core may be in line with the step of stranding the core wires, which means that the compacting of the core is done immediately after stranding the wires, preferably in the same line.

Compacting of the core may be done by die drawing or by rolling. Die drawing is a technique used to produce flexible metal wire by drawing the material through a series of dies (holes) of decreasing size. Rolling is a technique where the core wires pass along a series of compacting rolls or Turks heads.

In a preferred embodiment, the compacting of the core may be done by means of compacting rolls, because the wires will heat up less compared to die drawing, thereby less influencing the core's mechanical properties, e.g. tensile strength. The risk of loosing wire coating and/or of damaging the wire coating is also smaller compared to die drawing. Person skilled in the art will understand that both techniques may also be mixed depending on the wire material and its compacting resistance and the type of coating used and its compacting degree.

The number of wires may be between 5 and 25, and preferably 7 or 19. Most standard electric transmission cables have a core of 7 or 19 wires. They may be helicoidally twisted and axially aligned. In the case of 7 wires the core strand has a 1+6 construction, and in the case of 19 wires the core strand has a 1+6+12 SZ or ZS construction.

The wires of the core may be made of high-carbon steel. A high-carbon steel has a steel composition along the following lines: a carbon content ranging from 0.30% to 1.15%, a manganese content ranging from 0.10% to 1.10%, a silicon content ranging from 0.10% to 0.90%, sulfur and phosphorous contents being limited to 0.15%, preferably to 0.10% or even lower; additional micro-alloying elements such as chromium (up to 0.20%-0.40%), copper (up to 0.20%) and vanadium (up to 0.30%) may be added. All percentages are percentages by weight.

The core wires are coated individually to avoid corrosion in between the wires due to water leakage. This coating may be any coating keeping sufficient coating properties after compacting and may preferably be zinc, zinc-aluminum or zinc-aluminum-magnesium types of alloy.

A zinc-aluminum coating is a preferred coating. This coating on the steel core has an aluminum content ranging from 2 percent to 12 percent, e.g. ranging from 3 percent to 11 percent, with a preferable composition around the eutectoid position: Al about 5 percent. The zinc alloy coating further has a wetting agent such as lanthanum or cerium in an amount less than 0.1 percent of the zinc alloy. The remainder of the coating is zinc and unavoidable impurities. The zinc aluminum coating has a better overall corrosion resistance than zinc. In contrast with zinc, the zinc aluminum coating is temperature resistant and withstands the pre-annealing process of ACSS. Still in contrast with zinc, there is no flaking with the zinc aluminum alloy when exposed to high temperatures. All percentages are percentages by weight.

Zinc aluminum magnesium coatings also offer an increased corrosion resistance. In a preferable zinc aluminum magnesium coating the aluminum amount ranges from 0.1 percent to 12 percent and the magnesium amount ranges from 0.1 percent to 5.0 percent. The balance of the composition is zinc and unavoidable impurities. An example is an aluminum content ranging from 4 percent to 7.5 percent, and a magnesium content ranging from 0.25 to 0.75 percent. All percentages are percentages by weight.

The weight of the coating on the steel wires may be more than 100 g/m$^2$, and preferably more than 200 g/m$^2$.

In a further embodiment of the invention, the method may further comprise the step of additionally coating the compacted core. After compacting, it may be useful to coat the core again with preferably zinc, zinc-aluminum or zinc-aluminum-magnesium types of alloy. A person skilled in the art will understand that the second coating's requirements are less severe compared to the first, as the second coating does not have to withstand a compacting step.

The method may further comprise the step of forming a conductor surrounding the core.

The conductor may be made of, but not limited to aluminum, aluminum alloy, aluminum-magnesium-silicon alloy, aluminum composite.

Figure 3:
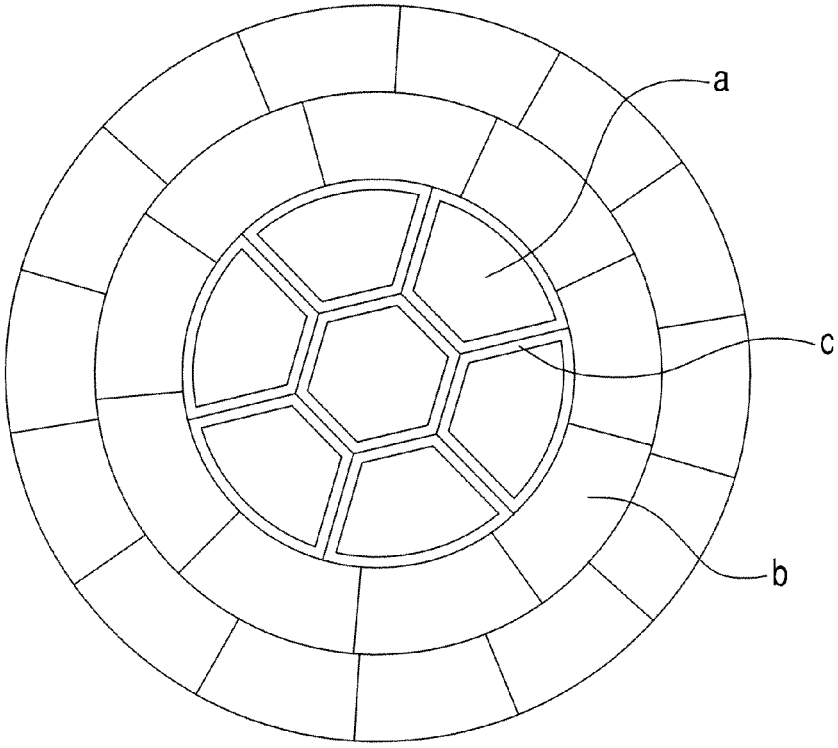
FIG. 3 illustrates a cross-section of an electric transmission cable with a compacted steel core and compacted conductors.

In a further embodiment of the invention, the conductor b may be compacted or made from trapezoidal shaped compacted wires, as shown in the example of FIG. 3. As already described above, it is known in the art and widely applied to compact the conductor to reduce the cable diameter and keep the same conductor current carrying capacity, or to keep the same cable diameter compared to non-compacted conductor cables and at the same time increase the conductor section. A compacted conductor may also be obtained by forming the conductor wires already in a trapezoidal shape before stranding. By combining a compacted core and a compacted conductor, the cable diameter may be significantly reduced or, when keeping the conventional cable diameter, the conductor section may be significantly increased.

As a second object, the present invention provides an electric transmission cable comprising a cable core having at least two individually coated and stranded wires and a conductor surrounding the core, wherein the core is compacted or manufactured from trapezoidal shaped compacted wires.

In accordance with the invention, the electric transmission cable may be, but may not be limited to AAC (All Aluminum Conductor), AAAC (All Aluminum Alloy conductor), ACSR (Aluminum Conductor Steel Reinforced), ACSS (Aluminum Conductor Steel Supported), ACAR (Aluminum Conductor Aluminum-Alloy Reinforced), AACSR (Aluminum Alloy Conductor Steel Reinforced), AAC/TW (All Aluminum Conductor/Trapezoidal Wires), AAAC/TW (All Aluminum Alloy conductor/Trapezoidal Wires), ACSR/TW (Aluminum Conductor Steel Reinforced/Trapezoidal Wires), ACSS/TW (Aluminum Conductor Steel Supported/Trapezoidal Wires).

In an embodiment of the invention, the steel core of the electric transmission cable may be a 7 wires steel core with a diameter decreased up to 10% when compared to the non-compacted 7 wires steel core. The air gaps that are present in the non-compacted steel core may be filled, although intermediate diameter reductions are also possible depending on cable requirements. Concomitantly, this configuration may allow keeping the same steel core section and, because of this, the same final ultimate tensile strength (UTS) may be guaranteed, without steel wire tensile strength changes. Consequently, the conductor design can be tailored by reducing its final diameter, while maintaining the conductor current carrying capacity, or by keeping its conventional diameter, thereby increasing the conductor section and its current carrying capacity.

In an embodiment of the invention, the steel core of the electric transmission cable may be a 7 wires steel core with a section increased up to 20% while maintaining its conventional diameter. The air gaps that are present in the non-compacted steel core may be filled, although intermediate diameter reductions are also possible depending on cable requirements. At the same time, this configuration may allow to increase linearly the UTS of the core without steel wire tensile strength changes. Obviously, the core section's weight may increase. Consequently, conductor design can be modified by increasing its diameter, thereby increasing the conductor current carrying capacity, or by keeping its conventional diameter, thereby keeping the conventional conductor section and its current carrying capacity. In this case the conductor may have a higher safety coefficient due to its increased steel section in comparison with the conductor section.

In an embodiment of the invention, the steel core of the electric transmission cable may be a 19 wires steel core with a diameter decreased up to 7% when compared to the non-compacted 19 wires steel core. The air gaps that are present in the non-compacted steel core may be filled, although intermediate diameter reductions are also possible depending on cable requirements. Concomitantly, this configuration may allow keeping the same steel core section and, because of this, the same final ultimate tensile strength (UTS) may be guaranteed, without steel wire tensile strength changes. Consequently, the conductor design can be tailored by reducing its final diameter, while maintaining the conductor current carrying capacity, or by keeping its conventional diameter, thereby increasing the conductor section and its current carrying capacity.

In an embodiment of the invention, the steel core of the electric transmission cable may be a 19 wires steel core with a section increased up to 14% while maintaining its conventional diameter. The air gaps that are present in the non-compacted steel core may be filled, although intermediate diameter reductions are also possible depending on cable requirements. At the same time, this configuration may allow to increase linearly the UTS of the core without steel wire tensile strength changes. Obviously, the core section's weight may increase. Consequently, conductor design can be modified by increasing its diameter, thereby increasing the conductor current carrying capacity, or by keeping its conventional diameter, thereby keeping the conventional conductor section and its current carrying capacity. In this latter case the conductor may have a higher safety coefficient due to the increased steel section in comparison with the conductor section.

Due to the compacting of the steel core, the openings between the outer wires of the steel core are reduced or have disappeared. As a result, the steel core when subjected to a tensile load has less or no structural elongation. This absence or reduction in structural elongation results in a reduced total elongation and in an increased E-modulus of the steel core. By compacting, this E-modulus may be increased by more than 10%, by more than 15%, or by more than 20%. Hence, a compacted steel core is much stiffer than a non compacted one, which results in a reduced sag. Reductions in the sag of up to 10% and more may be possible.

An electric transmission cable in accordance with the present invention is operable at higher electrical outputs than traditional cables when keeping a conventional diameter. If conventional electrical outputs are requested, its reduced diameter diminishes the effects of wind, ice or snow. In both cases the main mechanical, corrosion and thermal properties of the individual core wires are improved or kept. Additionally, due to the high degree of compaction of the core, the electric loses due to air gaps in between the core wires may be reduced, resulting in more effective electric power conduction.

The invention claimed is:

1. An electric transmission cable with reduced sag, said cable comprising:

a load carrying cable core having at least two individually coated and stranded wires made of a high-carbon steel, conductors surrounding said cable core, wherein said cable core is a compacted core which provides said reduced sag, and the wires are coated by a coating which maintains sufficient coating properties after compacting, wherein a weight of the coating on the wires is more than 100 g/m$^2$.

2. The electric transmission cable according to claim 1, wherein said conductors are selected from the group consisting of aluminum, aluminum alloy, aluminum-magnesium-silicon alloy, and aluminum composite.

3. The electric transmission cable according to claim 2, wherein said conductors are made of an aluminum alloy.

4. The electric transmission cable according to claim 1, wherein between 5 and 11 wires are provided.

5. The electric transmission cable according to claim 1, wherein the wires are coated with zinc, zinc-aluminum, or zinc-aluminum-magnesium types of alloy.

6. The electric transmission cable according to claim 1, wherein said compacted cable core is surrounded with an additional coating.

7. The electric transmission cable according to claim 1, wherein said conductors are made of aluminum.

8. The electric transmission cable according to claim 1, wherein said conductors are compacted or made from trapezoidal shaped compacted wires.

9. An electric transmission cable according to claim 1, wherein 7 of said wires are provided in a 1+6 construction.

* * * * *